United States Patent [19]

Ortiz

[11] 3,945,644

[45] Mar. 23, 1976

[54] ROTATABLE DISK CHANCE DEVICE HAVING EDGE INDICATION

[76] Inventor: Nilson V. Ortiz, 1064 S. Van Ness Ave. No. 4, San Francisco, Calif. 94110

[22] Filed: Jan. 6, 1975

[21] Appl. No.: 538,998

[52] U.S. Cl. ..... 273/143 D

[51] Int. Cl.[2] ..... A63F 5/04

[58] Field of Search ..... 273/143 R, 143 C, 143 D, 273/143 E, 143 A, 143 B, 147, 142 R, 142 A, 142 B, 142 C, 142 D, 142 E, 142 F, 142 G, 142 H, 142 HA, 142 J, 142 JA, 142 JB, 142 JC, 142 JD, 142 K, 134 E, 134 ES, 138 R, 1 R, 141 R, 141 A, 161; 35/74, 31 A; 46/47, 60, 64, 65, 67, 71

[56] References Cited

UNITED STATES PATENTS

| | | | |
|---|---|---|---|
| 222,710 | 12/1879 | Kightlinger | 273/142 JA |
| 1,353,491 | 9/1920 | Patterson | 273/143 R |
| 1,431,170 | 10/1922 | Maier | 273/142 R |
| 1,565,669 | 12/1925 | O'Reilly | 273/143 R |
| 1,709,401 | 4/1929 | Hermann | 273/142 R |
| 1,752,089 | 3/1930 | Hynes | 273/142 JA X |
| 2,468,000 | 4/1949 | Taylor | 273/143 R |
| 2,500,830 | 3/1950 | Jones | 273/142 R |

FOREIGN PATENTS OR APPLICATIONS

| | | | |
|---|---|---|---|
| 987,912 | 3/1965 | United Kingdom | 273/142 F |
| 494,531 | 5/1954 | Italy | 273/143 R |
| 1,043,171 | 11/1958 | Germany | 273/143 R |

*Primary Examiner*—Anton O. Oechsle
*Assistant Examiner*—Arnold W. Kramer
*Attorney, Agent, or Firm*—Robert K. Rhea

[57] ABSTRACT

A game toy comprising a base, having an upstanding cylindrical ring wall provided with a plurality of circumferentially spaced windows, telescopically receives the depending wall of a top member rotatably supported by a base axle. A plurality of symbols printed on the periphery of the top wall are successively visible through the base ring windows when the top member is rotated. The top member is provided with a plurality of upstanding radial ribs. A releasable brake including a flexible flap, supported by the base, frictionally engages the ribs of the top member when it is manually spun, in either direction about its vertical axis, to stop its rotation and expose, by chance, the symbols through the base windows.

1 Claim, 3 Drawing Figures

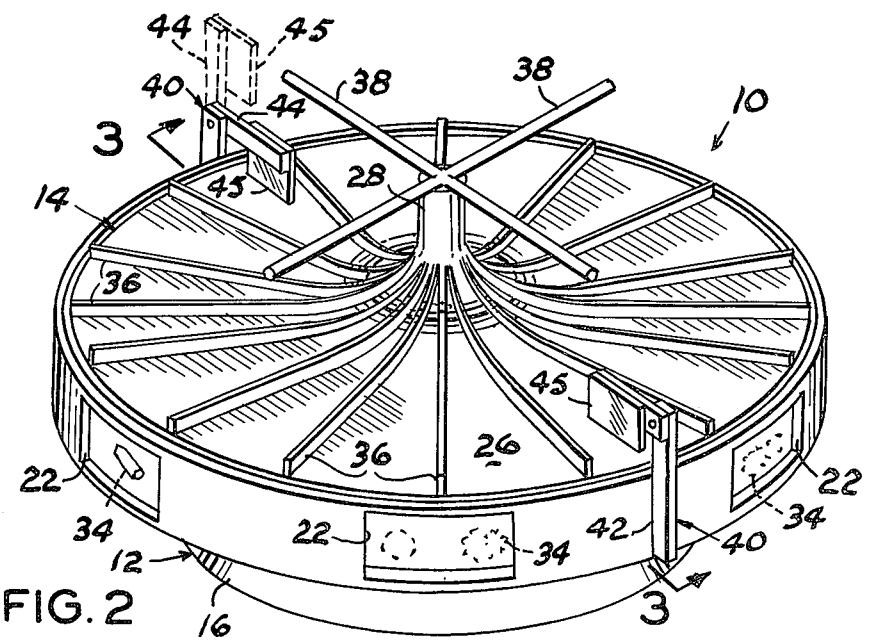
FIG. 1
FIG. 2
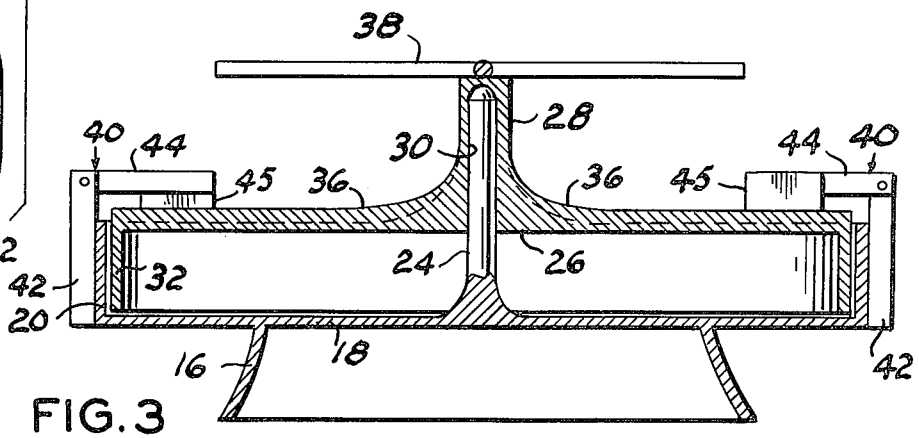
FIG. 3
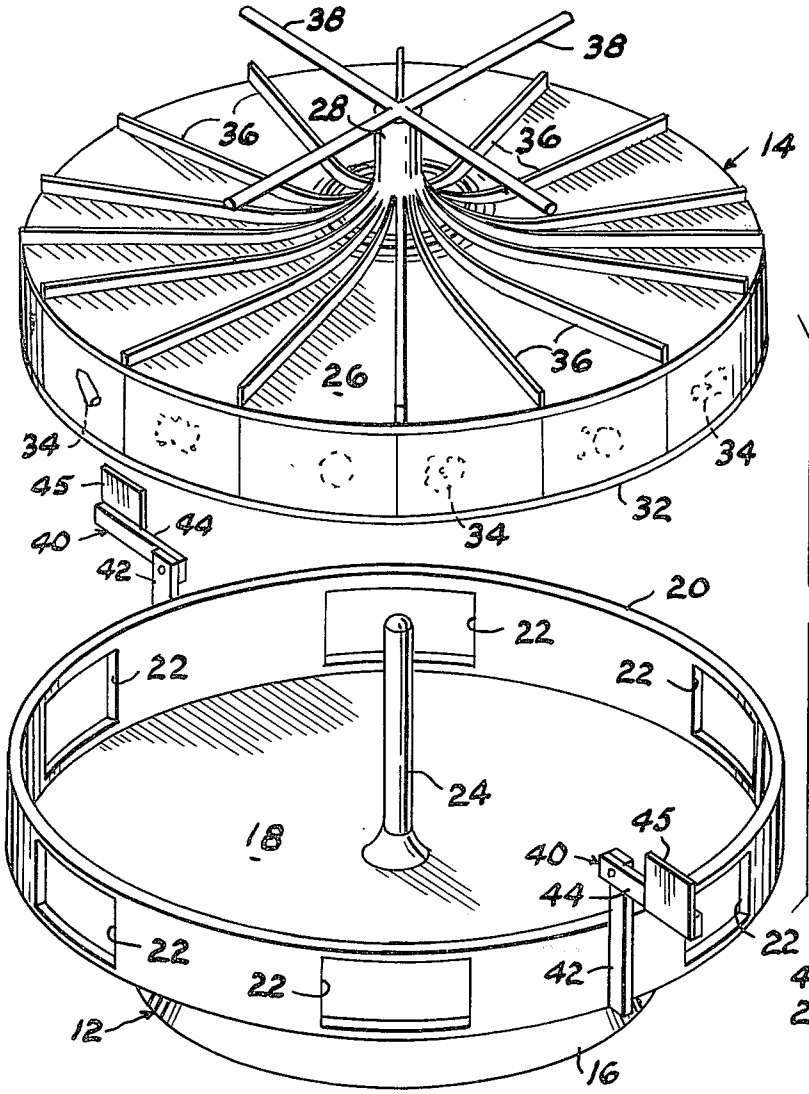

ROTATABLE DISK CHANCE DEVICE HAVING EDGE INDICATION

BACKGROUND OF THE INVENTION

Field of the Invention

The present invention relates to toys and more particularly to a base supported spinning top member toy exposing symbols through windows formed in the base wall.

Toy apparatus of this type has usually comprised a polygonal-shaped body capable of being spun about its vertical axis and having symbols or indicia on its several faces which are exposed, by chance, on an upwardly disposed face of the body when at rest indicating a parameter according to the game being played.

This invention provides a game of chance apparatus in which the variable position of the top may be partially controlled by a manually operated brake operable by each player during his playing turn.

SUMMARY OF THE INVENTION

A generally horizontal base is provided with an upstanding ring-like cylindrical wall having a plurality of circumferentially spaced windows therein. A top member is coaxially supported in rotatable relation by an upstanding axle on the base. The top member is provided with a depending ring-like cylindrical wall telescopically received by the base wall. A plurality of symbols are printed on the circumference of the top member wall and are successively visible through the base wall windows. Means on the top member permits manual rotation of the top in a spinning action in either direction. Manually operated brake means, supported by the base, frictionally engage upstanding radial ribs formed on the top member for braking rotation of the top member and aligning symbols thereon with the position of the base windows, when the top member is at rest, according to the rules of a game being played.

The principal object of this invention is to provide a game of chance for a plurality of players.

BRIEF DESCRIPTION OF THE DRAWINGS

FIG. 1 is a perspective view of the device;

FIG. 2 is an exploded perspective view; and,

FIG. 3 is a vertical cross sectional view taken substantially along the line 3—3 of FIG. 1.

DESCRIPTION OF THE PREFERRED EMBODIMENT

Like characters of reference designate like parts in those figures of the drawings in which they occur.

In the drawings:

The reference numeral 10 indicates the toy, as a whole, which is cylindrical in general configuration, comprising a base 12 and a top 14. The base 12 is formed by a stand 16 supporting a horizontal plate 18 having an annular upstanding ring wall 20 at its perimeter. The wall 20 is provided with a plurality of circumferentially spaced rectangular windows 22. An upstanding axle 24 is coaxially connected with the base plate 18. The axle projects above the horizontal upper limit of the wall 20 a selected distance.

The top 14 comprises a horizontally disposed panel portion 26 having an upstanding central spindle 28 provided with a downwardly open coaxial socket 30 for receiving the axle 24 and journalling the top 14. The perimeter of the top panel 26 is provided with a depending annular wall 32 dimensioned to be telescopically received by the base ring wall 20. The outer circumferential surface of the top wall 32 is provided with a plurality of juxtaposed rectangular areas, each having symbols 34 printed thereon and visible through the base plate windows 22 when registered therewith. The top panel 26 is provided with a plurality of upstanding vanes or ribs 36 extending radially outward from the spindle 28 for the purposes presently explained. The top 14 further includes a plurality of horizontally disposed rod-like radial handles 38 secured to the spindle 28 for manually starting the top in a spinning action in either direction.

A pair of diametrically opposite brake means 40 releasably engage the ribs 36 for stopping the spinning action of the top 14. Each brake means comprises a standard 42 vertically secured to an arc of the outer surface of the base wall 20 and an arm 44 pivotally secured at one end to the upper end of the standard for vertical pivoting movement about a horizontal axis toward and away from the top panel 26. Each brake further includes a flexible material flap 45 secured to the arm 44 in depending relation and resiliently engaging, by its depending edge portion, the top panel ribs 36 when the brakes are disposed as shown by solid lines in FIG. 1 and the top member 14 is rotated.

OPERATION

In operation, a set of rules and desired objectives constituting a game is selected by players, for example, the symbols 34 may represent the nine planets of the solar system and obstructions hindering interplanetary travel, such as comets, space patrols etc.. Each player is assigned one window 22 and has a predetermined number of spins of the top for his turn and on his first spin endeavors to position a planet symbol within his window from which to launch an imaginary space vehicle. A second spin of the top is intended to determine, by chance, the planet among the remaining eight to which he shall travel which must appear in his window. During the time the top member 14 is spinning he may operate one of the brake means 40 by pivoting the flap 44 toward its solid line position of FIG. 1 for retarding and stopping the movement of the top. The flexible brake flaps 45 stop the rotation of the top member so a like plurality of the symbols 34 are in alignment with the plurality of windows 22. Nonselected symbols representing hinderances may disqualify the player, prolong or terminate the game according to the rules selected.

Obviously the invention is susceptible to changes or alterations without defeating its practicability. Therefore, I do not wish to be confined to the preferred embodiment shown in the drawings and described herein.

I claim:

1. A game toy, comprising:

an upwardly open cylindrical base having a plurality of circumferentially spaced windows in its wall;

an upstanding axle coaxially supported by said base;

a downwardly open cylindrical top telescopically received by said base, said top having a central upstanding spindle having a socket therein surrounding said axle for angular rotation of said top relative to said base;

a plurality of upstanding radial ribs on the upper limit of said top;

brake means supported by said base and operable to retard rotation of said top, said brake means including, a standard vertically secured to a peripheral portion of the wall of said base, an arm pivotally connected with said standard for movement toward and away from the upper limit of said top, and, a flexible flap secured to said arm in depending relation for indexing contact with said ribs when said arm overlies the upper limit of said top; and, a plurality of symbols indicating parameters of a game to be played printed on the outer surface of the wall of said top in circumferentially spaced relation and being successively visible through the respective windows when said top is rotating in either direction, whereby, some of the symbols are displayed through the windows when said top is indexed to a stop.

* * * * *